United States Patent [19]

Lath

[11] Patent Number: 5,041,144

[45] Date of Patent: Aug. 20, 1991

[54] PROCESS OF PURIFYING RAW FUEL GAS PRODUCED BY A GASIFICATION OF SOLID FUELS

[75] Inventor: Erhard Lath, Griesheim, Fed. Rep. of Germany

[73] Assignee: Metallgesellschaft Aktiengesellschaft, Frankfurt am Main, Fed. Rep. of Germany

[21] Appl. No.: 561,886

[22] Filed: Aug. 2, 1990

[30] Foreign Application Priority Data

Aug. 11, 1989 [DE] Fed. Rep. of Germany ..... 3926575

[51] Int. Cl.[5] ..... C10J 3/14; C10J 3/16; C10K 1/10

[52] U.S. Cl. ..... 48/197 R; 48/203; 48/206; 55/70; 55/71; 423/237; 423/240

[58] Field of Search ..... 48/197 R, 202, 203, 48/206, 209, 210; 55/70, 71, 82, 84, 85, 89, 94, 97; 423/215.5, 238, 239, 240 R

[56] References Cited

U.S. PATENT DOCUMENTS

| | | | |
|---|---|---|---|
| 4,032,305 | 6/1977 | Squires | 48/197 R |
| 4,065,273 | 12/1977 | Rudolph | 55/86 |
| 4,149,859 | 4/1979 | Vigesdal | 48/197 R |
| 4,233,275 | 11/1980 | Kimura et al. | 423/237 |
| 4,235,625 | 11/1980 | Tyipmer | 48/206 |
| 4,252,543 | 2/1981 | Giles | 48/197 R |
| 4,274,839 | 6/1981 | Leas | 48/202 |
| 4,505,719 | 3/1985 | Golke et al. | 55/85 |
| 4,731,099 | 3/1988 | Ergezinger | 48/197 R |

*Primary Examiner*—Peter Kratz
*Attorney, Agent, or Firm*—Herbert Dubno

[57] ABSTRACT

The raw gas produced by gasification is cooled to temperatures from 150° to 400° C. and has an $NH_3$ content of at least 0.1% by volume as it is fed to a spray drying zone. Recycle water is fed to and is entirely evaporated in the spray drying zone. The raw gas from the spray drying zone contains water vapor and is passed through a filter, in which part of the solids and of the halogen compounds are collected in a dry state. The raw gas is subsequently passed through a saturation zone, in which the raw gas is directly contacted with sprayed water and is saturated with water vapor and cooled to temperatures of 50° to 90° C. Water which contains salt and solids and has a pH value of 7.5 to 9.5 is withdrawn from the saturation zone and is at least partly fed as recycle water to the spray drying zone. The raw gas from the saturation zone is aftertreated for a removal of liquid droplets which contains dust and salt.

3 Claims, 1 Drawing Sheet

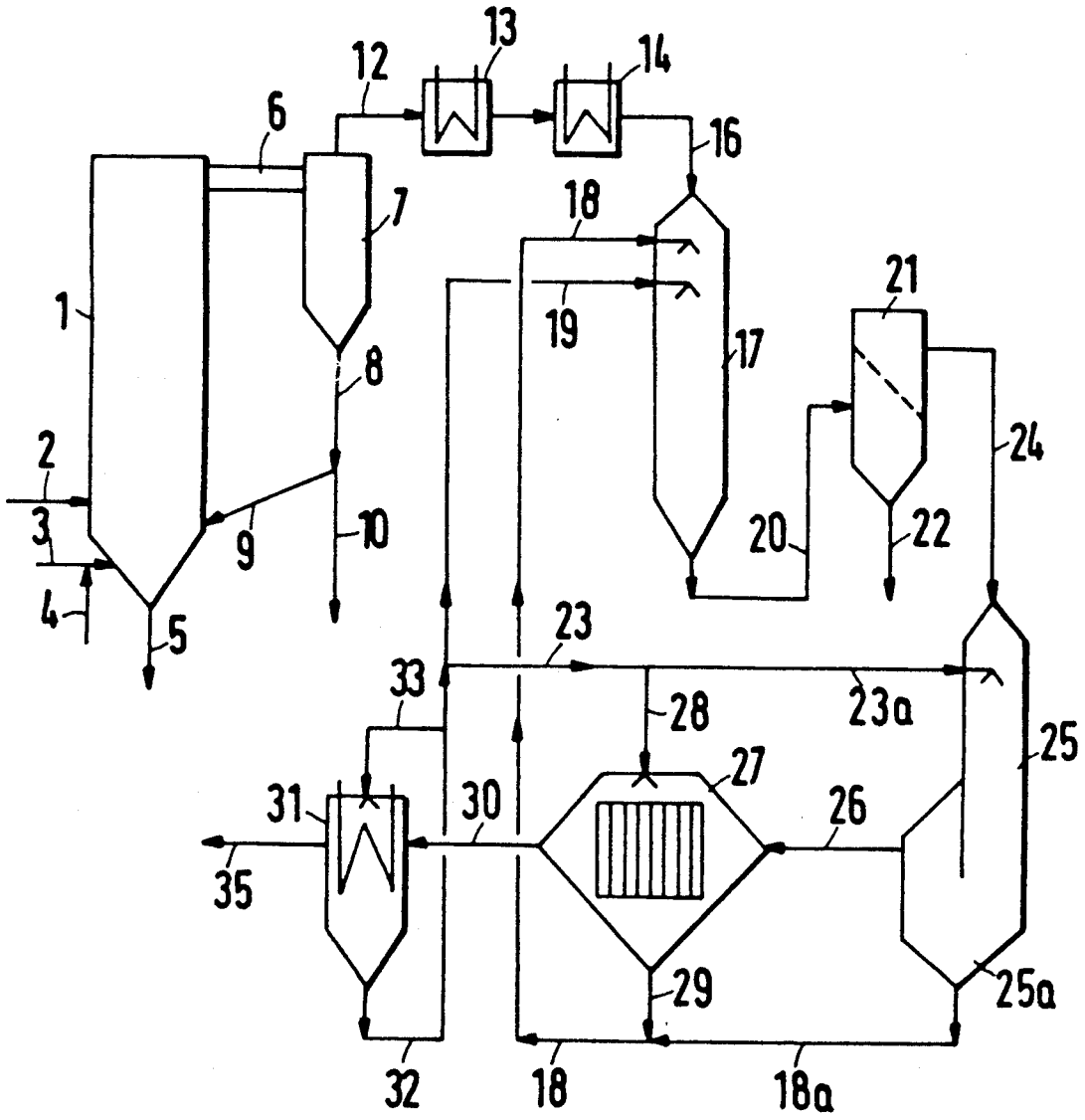
1
2
3
4
5
6
7
8
9
10
12
13
14
16
17
18
19
20
21
22
23
23a
24
25
25a
26
27
28
29
30
31
32
33
35
18
18a

PROCESS OF PURIFYING RAW FUEL GAS PRODUCED BY A GASIFICATION OF SOLID FUELS

FIELD OF THE INVENTION

My present invention relates to a process of purifying raw gas produced by a gasification of solid fuels, particularly of carbonaceous waste materials, by means of an oxygen-containing gasifying agent, whereby a raw gas which contains carbon oxides, hydrogen and methane and, as impurities, dust, $NH_3$ and hydrogen halides, is produced at temperatures of about 500° to 1200° C. Garbage may also be fed to the gasifier.

BACKGROUND OF THE INVENTION

The gasification of coal and carbonaceous waste materials and also of garbage is known and has been described, e.g. in U.S. Pat. No. 4,032,305. Problems arise in the purification of the raw gas produced by the gasification. Processes of effecting that purification are known but result in a formation of additional waste material.

OBJECTS OF THE INVENTION

It is an object of the invention to remove $NH_3$, HCl, HF and dust from the raw gas in a manner which is simple and ensures that the quantity of impurities to be removed will be minimized.

Another object of the invention is to provide a process for removing impurities from a fuel gas produced by gasification of carbon-containing materials including garbage, whereby disadvantages of earlier systems are avoided.

It is also an object of the invention to provide an improved method of producing a fuel gas by gasification which will minimize the cost and complexity of removal of impurities therefrom.

Still another object of the invention is to provide an improved apparatus for carrying out the method of the invention.

SUMMARY OF THE INVENTION

In accordance with the invention, the raw gas is cooled to temperatures from 150° to 400° C., the cooled raw gas, which contains at least 0.1% by volume $NH_3$, is fed to a spray drying zone and is contacted with recycled water that is sprayed into that zone and is entirely evaporated.

The water vapor-containing raw gas which comes from the spray drying zone and is at temperatures from 80° to 250° C. is passed through a filter. At least 80% by weight of the solids contained in the raw gas as it enters the filter and at least 50% by weight of the halogen compounds are removed in the filter in a dry process.

The raw gas from the filter is then passed through a saturation zone, in which the raw gas is directly contacted with sprayed water, whereby the raw gas is saturated with water vapor and is cooled to temperatures from 50° to 90° C. Water which contains salt and solids and has a pH value from 7.5 to 9.5 is withdrawn from the saturation zone and at least a portion of said water is fed as recycle water to the spray drying zone.

Finally the raw gas from the saturation zone is aftertreated to remove dust and salt-containing liquid droplets.

In the process according to the invention, the raw gas entering the spray drying zone has a substantial $NH_3$ content from at least 0.1% by volume to about 1% by volume. That $NH_3$ content is usually inherently obtained in the raw gas because the fuels are gasified rather than combusted and the energy required for that purpose is furnished by a partial oxidation.

The gasifying agent may consist of oxygen, air or oxygen-enriched air and in most cases also of water vapor, which may be replaced in part by $CO_2$.

The heating value of the gas produced by the gasification may be utilized in a combustion plant and, e.g., in a power plant. For that purpose it is important that the raw fuel gas is purified economically but to a satisfactory degree.

The purification of the raw gas in the process in accordance with the invention does not necessarily result in a contaminated sewage, which would have to be purified. The process can be carried out without an addition of any chemicals, provided that the raw gas entering the spray drying zone has a sufficiently high $NH_3$ content. This will usually be the case without an addition of extraneous $NH_3$ if the raw gas has been produced by a gasification of waste materials and municipal garbage.

It is very important in the process that temperatures from 80° to 250° C. are maintained in the spray drying zone. Under such conditions, ammonium halides are produced directly from the gas phase from $NH_3$, HCl and HF and are deposited in a solid, dry form on existing solid particles by desublimation and agglomeration. The resulting agglomerates can then easily be filtered off.

Heavy metals or heavy metal compounds are also desublimated and in the spray drying zone are preferentially agglomerated on the desublimated halogen particles and on the dust which has been fed with the raw gas and can then also be removed from the gas to a sufficient degree.

Owing to the sufficiently high $NH_3$ content of the raw gas and owing to the ammonia which has been introduced into the recycle water, the water has a pH value from about 7.5 to 9.5 so that inexpensive plain carbon steel can be used in the plants and piping. A cost-decreasing saving of energy will be achieved because water is required only in a relatively small amount in the spray drying zone and in the saturation zone.

The gas coming from the saturation zone still contains mainly dust and salt-containing liquid droplets so that an aftertreatment is required. That aftertreatment may suitably be carried out by means of a wet-process electrostatic precipitator, a wet scrubber, a mist collector, which may succeed a wet scrubber, or a condenser. It is important that the dust and the salt-containing liquid droplets are removed without an addition of chemicals. The water which has thus been collected and contains dust and salt is also fed to the spray drying zone.

BRIEF DESCRIPTION OF THE DRAWING

The above and other objects, features and advantages of the present invention will become more readily apparent from the following description, reference being made to the accompanying drawing, the sole FIGURE of which is a flow diagram of a plant or apparatus for carrying out the process or method of the invention.

SPECIFIC DESCRIPTION

Solid fuels, such as coal or biomass or carbonaceous waste materials, are supplied in line 2 to a gasifying reactor 1 and are gasified therein by means of air coming from line 3. The waste materials may consist, e.g. of municipal garbage. Water vapor from line 4 may also be supplied to the reactor 1 as a gasifying agent.

The gasifying air may be enriched with oxygen or commercially pure oxygen and together with water vapor may be used as a gasifying agent. In the process illustrated in the drawing, the fuels or the garbage are gasified in a circulating fluidized bed. Alternatively, the gasification may be effected in a fluidized bed, in a solids-entraining gas stream or in a fixed bed. The gasifying reactor may alternatively consist of a multiple-hearth furnace.

A mixture of fuel gas and solids (raw gas) flows through a duct 6 to a cyclone 7, in which a major part of the solids is collected from the gas. A plurality of cyclones, which may be connected in parallel or series, may be used rather than a single cyclone 7.

The solids are then recycled in part to the gasification reactor 1 through lines 8 and 9 and surplus solids may be withdrawn through line 10. Ash is withdrawn directly from the reactor 1 through line 5.

The dust-containing raw gas contains combustible components as well as $NH_3$, HCl and usually contains also a small amount of HF and is at temperatures from about 500° to 1200° C. it leaves the cyclone 7 through line 12. A first indirect cooling is effected in the heat exchanger 13 and the heat which has been dissipated may be used, e.g. to preheat the gasifying air flowing in line 3. That option has not been shown in the drawing for the sake of simplicity. A further cooling may be effected in the heat exchanger 14 if this is desirable.

From the heat exchanger 14 the precooled raw gas at temperatures from 150° to 400° C. flows in line 16 to a spray dryer 17. Care is taken that the raw gas in line 16 contains at least 0.1% by volume $NH_3$, and its $NH_3$ content is available in a more than sufficient quantity for the reaction with the hydrogen halides contained in the raw gas.

While the raw gas produced by the gasification of waste material usually contains sufficient $NH_3$, extraneous $NH_3$ may be added at a controlled rate if the $NH_3$ content is inadequate. In the spray dryer 17, recycle water from line 18 is sprayed into the hot raw gas coming from the line 16. That water contains halogen compounds, heavy metal compounds and dust, which have been scrubbed out of the raw gas elsewhere. For this reason the pH value of the recycle water lies in the range form 7.5 to 9.5. Water which comes from the line 19 and contains almost no impurities is also sprayed in the spray dryer 17. Special care is taken that additional chemicals are not fed to the spray drying 17. Such an addition of chemicals would only necessitate a disposal of larger amounts of waste materials.

The entire water which has been fed to the spray dryer 17 is evaporated therein. At the same time, $NH_3$, HCl and HF react in the presence of the recycled solids and salts to form agglomerates, which contain ammonium halides. Under the conditions in the spray dryer, a formation of aerosols will be avoided, particularly because condensation nuclei are supplied in the recycle water from line 18.

A mixture of raw gas and solids flows at a temperature in the range from 80° to 250° C. through line 20 to a filter 21, in which the solids are removed in a dry process from the gas. That filter may consist of a bag filter or tube filter or an electrostatic precipitator or one or more cyclones. It is important to separate in the filter 21 at least 80% by weight of the solids and at least 50% by weight of the halogen compounds contained in the raw gas from line 20. The solids and halogen compounds which have been separated are discharged in line 22. At least 50% by weight of the heavy metals are also separated in the filter 21. The amount of solids in line 22 has not been increased by an addition of extraneous chemicals and said solids must be removed and dumped.

The raw gas which has partly been dedusted then flows in line 24 to a saturation zone 25, in which water from line **23*a* is sprayed so that the raw gas is cooled further, saturated with water vapor and partly dedusted further. Particularly halogen compounds and heavy metal compounds are effectively separated by the sprayed water. Water which contains salt and solids and has a pH value in the range from 7.5 to 9.5 is withdrawn from the sump 25*a* of the saturation zone and is recycled through lines 18*a* and 18 to the spray dryer 17. The gas which leaves the saturation zone 25 through line 26** has a temperature in the range from 50 to 90° C.

In accordance with the drawing, a wet-process electrostatic precipitator 27 is provided for the aftertreatment which is required and said electrostatic precipitator 27 is fed with water from line 28. Water which contains dust and salt is withdrawn in line 29 and is added to the recycle water in line 18. In an arrangement differing from that shown in the drawing, a wet scrubber and/or a mist collector may be used rather than the wet-process electrostatic precipitator 27.

Dedusted gas which contains water vapor is passed from the electrostatic precipitator 27 in line 30 to a condenser 31, in which part of the water vapor is condensed by an indirect cooling and is thus removed. The condensate consists of fairly clean water and is withdrawn in line 32 and is distributed to the lines 23 and 19. A partial stream may be recycled through line 33 and passed as purge water through the condenser. No condenser 31 is required behind a wet-process electrostatic precipitator. The heating value of the gas can be controlled by an adjustment of the water vapor content of the gas in the condenser. Purified fuel gas is available in line 35 and may be utilized, e.g. in a power plant. Before that gas is utilized, it may be heated, e.g. in the heat exchanger 14, by an indirect heat exchange with the raw gas flowing in line 12. The purifying process in accordance with the invention may readily be carried out to provide in line 35 a fuel gas which contains per $sm^3$ ($sm^3$=standard cubic meter) an HCl content not in excess of 10 mg and contents of dust, HF and heavy metals not in excess of 1 mg each.

SPECIFIC EXAMPLE

In a plant as shown in the drawing, waste material is gasified which consists of a mixture of municipal garbage, industrial garbage and clarifier sludge. In the plant, the lines 4, 10 and 33 shown in the drawing have been omitted. Waste material at a rate of 6500 kg/h is gasified by means of air which is supplied in line 3 at a rate of 8000 $sm^3$ ($sm^3$=standard cubic meter) and has been preheated to 600° C. in the heat exchanger 13. The waste material has the following elementary analysis:

C—31.1% by weight

H—4.6% by weight

O—19.0% by weight
N—0.6% by weight
S—0.2% by weight
Cl—0.4% by weight
$H_2O$—28.0% by weight
Ash—16.05 by weight
Heavy metals—0.05% by weight.

The waste materials has a heating value of 12,600 kJ/kg. The gasification is effected in a circulating fluidized bed under a pressure of 1.35 bars. The gasification reactor 1 has an inside height of 14 meters and an inside diameter of 2 meters. Two cyclones 7 are connected to the duct 6. Raw gas at a temperature of 950° C. flows at a rate of 15,000 $sm^3/h$ in line 12 to the first heat exchanger 13 and comprises the following main components:

CO—13.6% by volume
$H_2$—10.4% by volume
$CO_2$—7.1% by volume
$CH_4$—1.6% by volume
$C_nH_m$—0.7% by volume
$N_2$—42.8% by volume
$H_2S+COS$—0.05% by volume
$NH_3+HCN$—0.3% by volume
$HCl+HF$—0.1% by volume
$H_2O$—23.35% by volume That raw gas contains per $sm^3$ 10,000 mg inert dust and 34 mg heavy metals. The following temperatures occur in the various lines during the purification of that raw gas:

| Line | 16 | 18 | 19 | 20 | 26 | 35 |
|---|---|---|---|---|---|---|
| Temperature (°C.) | 280 | 76 | 69 | 120 | 76 | 69 |

Water flows through the following lines at the following rates:

| Line | 18 | 19 | 23a | 28 | 29 | 32 |
|---|---|---|---|---|---|---|
| Rate (kg/h) | 750 | 950 | 500 | 500 | 500 | 2200 |

The spray dryer 17 has a height of 6 meters and is 1.5 meters in diameter. The succeeding filter 21 consists of a bag filter. Filter dust at a rate of 180 kg/h becomes available in line 22 and together with ash flowing from the gasification reactor 1 in line 5 at a rate of 1200 kg/h must be disposed of. The purified fuel gas flowing off in line 35 contains per $sm^3$ less than 1 mg dust, less than 5 mg $NH_4Cl$ and less than 1 mg heavy metals and also 1.5 g $NH_3$. The gas is heated to 500° C. in the heat exchanger 14 and is combusted in a power plant boiler. The boiler is operated in a circulating fluidized bed system and is fed also with coal. In that boiler, the sulfur compounds are incorporated in the boiler ash in known manner by means of limestone.

I claim:

1. A process for purifying a raw gas produced by a gasification of solid fuels including carbonaceous waste materials by an oxygen-containing gasifying agent, said process comprising the steps of:

(a) recovering from said gasification a raw gas containing carbon oxides, hydrogen, methane, $NH_3$ in an amount of at least 0.1% by volume, dust and hydrogen halides, at a temperature of about 500° to 1200° C.;

(b) cooling the raw gas recovered in step (a) to a temperature of substantially 150° to 400° C.;

(c) feeding the raw gas cooled in step (b) to a spray drying zone and contacting the raw gas in said spray drying zone with recycled water sprayed into said zone and completely evaporated therein to produce a solids-entraining water-vapor-containing raw gas at a temperature of 80° to 250° C.;

(d) filtering said solids-entraining water-vapor-containing raw gas from step (c) to remove at least 80% by weight of the solids therefrom and to remove at least 50% by weight of all halogen compounds contained therein in a dry process and produce a filtered gas;

(e) passing said filtered gas from step (d) through a saturation zone and contacting said filtered gas in said saturation zone directly with sprayed water to saturate said filtered gas with water vapor and cool said filtered gas to a temperature of 50° to 90° C., and collecting water in said saturation zone which contains salt and solids and has a pH of substantially 7.5 to 9.5;

(f) withdrawing said water which contains salt and solids and has a pH of substantially 7.5 to 9.5 from said saturation zone and feeding at least a portion of the water withdrawn from said saturation zone as said recycle water to said spray drying zone in step (c); and (g) recovering the filtered gas saturated with water vapor and cooled to said temperature of 50° to 90° C. from said saturation zone of step (e) and aftertreating the recovered filtered gas to remove dust and salt-containing liquid droplets therefrom.

2. The process according to claim 1 wherein the aftertreatment of the raw gas coming from the saturation zone is effected in a wet-process electrostatic precipitator, a wet scrubber, a mist collector and/or a condenser and at least a portion of the water which has thus been collected is fed as recycle water to the spray drying zone.

3. The process according to claim 1 wherein the aftertreated gas is cooled, water vapor is separated by condensation and at least part of the condensate is fed to the saturation zone.

* * * * *